US010239121B2

(12) United States Patent
Ido et al.

(10) Patent No.: US 10,239,121 B2
(45) Date of Patent: Mar. 26, 2019

(54) CLAY-LIKE COMPOSITION FOR SINTERED PRECIOUS METAL BODY

(71) Applicant: MITSUBISHI MATERIALS CORPORATION, Tokyo (JP)

(72) Inventors: Yasuo Ido, Sanda (JP); Shinji Otani, Sanda (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 180 days.

(21) Appl. No.: 15/038,222

(22) PCT Filed: Nov. 26, 2014

(86) PCT No.: PCT/JP2014/081179
§ 371 (c)(1),
(2) Date: May 20, 2016

(87) PCT Pub. No.: WO2015/080128
PCT Pub. Date: Jun. 4, 2015

(65) Prior Publication Data

US 2016/0288205 A1 Oct. 6, 2016

(30) Foreign Application Priority Data

Nov. 28, 2013 (JP) ..... 2013-246151

(51) Int. Cl.
*B22F 1/00* (2006.01)
*C22C 1/04* (2006.01)

(52) U.S. Cl.
CPC ..... *B22F 1/0059* (2013.01); *C22C 1/0466* (2013.01); *B22F 2301/25* (2013.01); *B22F 2998/00* (2013.01)

(58) Field of Classification Search
CPC ..... B22F 2301/25
USPC ..... 75/252
See application file for complete search history.

(56) References Cited

U.S. PATENT DOCUMENTS

| | | | | |
|---|---|---|---|---|
| 3,653,884 A | | 4/1972 | Davies et al. | |
| 4,106,932 A | * | 8/1978 | Blachford | B22F 1/0059 264/4.7 |
| 4,483,905 A | * | 11/1984 | Engstrom | B22F 1/0059 419/2 |
| 9,999,922 B1 | * | 6/2018 | Struve | B22F 1/0059 |

FOREIGN PATENT DOCUMENTS

| | | | | |
|---|---|---|---|---|
| EP | 0457350 | A1 | | 11/1991 |
| JP | 04-026707 | A | | 1/1992 |
| JP | 2001-234081 | A | | 8/2001 |
| JP | 2001234081 | A | * | 8/2001 |
| JP | 2002-097501 | A | | 4/2002 |
| JP | 2005-187858 | A | | 7/2005 |
| JP | 2007-154304 | A | | 6/2007 |
| JP | 4265127 | B2 | | 5/2009 |
| WO | WO-2014/157527 | A1 | | 10/2014 |

OTHER PUBLICATIONS

International Search Report dated Jan. 13, 2015, issued for PCT/JP2014/081179.
Supplementary European Search Report dated Jul. 5, 2017, issued for the European patent application No. 14865036.9.

* cited by examiner

*Primary Examiner* — Colleen P Dunn
*Assistant Examiner* — Jeremy C Jones
(74) *Attorney, Agent, or Firm* — Locke Lord LLP; James E. Armstrong, IV; Nicholas J. DeCeglie, Jr.

(57) ABSTRACT

A clay-like composition for forming a sintered precious metal body, the clay-like composition containing at least one powder selected from the group consisting of precious metal powders and precious metal alloy powders, an organic binder, an organic additive and water, wherein the clay-like composition has an initial hardness measured using a type E durometer of E8 to E20, and has a hardness after standing for one hour at room temperature of E40 or less.

5 Claims, No Drawings

CLAY-LIKE COMPOSITION FOR SINTERED PRECIOUS METAL BODY

TECHNICAL FIELD

The present invention relates to a clay-like composition for forming a sintered precious metal body.

Priority is claimed on Japanese Patent Application No. 2013-246151, filed Nov. 28, 2013, the content of which is incorporated herein by reference.

BACKGROUND ART

Conventionally, jewelry and fine arts and crafts and the like made of precious metals, typified by rings and the like, are generally produced by the casting or forging of a material containing a precious metal such as silver or gold.

However, in recent years, precious metal clays containing precious metal powders such as silver or gold (clay-like compositions for forming sintered bodies) have become commercially available, and methods have been proposed for producing precious metal jewelry and fine arts and crafts having any desired shape by making these precious metal clays into the desired arbitrary shape and then performing firing (for example, see Patent Documents 1 to 3).

By using these types of methods, precious metal clays can be used to freely shape forms in the same manner as typical clay work, and by drying the shaped body obtained by shaping the precious metal clay, and then firing the clay in a heating furnace, precious metal jewelry and fine arts and crafts and the like can be produced extremely easily.

CITATION LIST

Patent Documents

Patent Document 1: Japanese Patent No. 4,265,127

Patent Document 2: Japanese Unexamined Patent Application, First Publication No. H04-26707

Patent Document 3: Japanese Unexamined Patent Application, First Publication No. 2005-187858

DISCLOSURE OF INVENTION

Problems to be Solved by the Invention

When producing this type of sintered precious metal body, the precious metal clay must first be shaped, but because this type of shaping is mainly performed by hand, the clay can sometimes start to dry during this shaping, making processes such as bending more difficult. Ever increasing diversity in design and personal preferences has resulted in more complex shapes for the sintered precious metal bodies, meaning the time required for shaping these bodies has tended to increase. This means conventional clay-like compositions tend to dry out during the shaping process, and if an attempt is made to bend this type of dried composition, then cracks appear in the surface of the clay, and further bending can result in breakage. As a result, when rings or the like are made, the shaping must be completed within a limited time period, meaning there is a limit to the design features that are possible.

The present invention has been developed in light of these circumstances, and was completed as a result of intensive research aimed at achieving the object described below.

The present invention has an object of providing a clay-like composition for forming a sintered precious metal body which exhibits excellent flexibility and bendability during shaping of the precious metal clay, and therefore enables the shaping time for bending and the like to be lengthened.

Means for Solving the Problems

The present invention provides a clay-like composition for forming a sintered precious metal body, the clay-like composition containing at least one powder selected from the group consisting of precious metal powders and precious metal alloy powders, an organic binder, an organic additive and water, wherein the clay-like composition has an initial hardness measured using a type E durometer of E8 to E20, and has a hardness after standing for one hour at room temperature of E40 or less.

This type of clay-like composition for forming a sintered precious metal body is usually stored and sold in a wrapped state with the composition covered with a packaging material such as a film or the like having excellent gas barrier properties in order to prevent hardening of the composition as a result of drying. In the case of a conventional clay-like composition, the composition is comparatively soft and easily shaped immediately following removal from the packaging material, but the hardness increases as time passes, making bending and the like of the composition during shape formation difficult.

The clay-like composition for forming a sintered precious metal body according to the present invention has an initial hardness, measured using a type E durometer immediately following removal from the packaging material, that is from E8 to E20, and has a hardness after standing for one hour at room temperature that is E40 or less. Accordingly, the increase over time in the hardness of the clay-like composition for forming a sintered precious metal body is small, and therefore the ability to shape the composition during shaping operations is not impaired as a result of large increases in the hardness of the clay-like composition for forming a sintered precious metal body, the clay-like composition maintains excellent flexibility and bendability, and rings and the like can be produced with comparative ease.

In this description, the initial hardness refers to the hardness value measured within the period of about one minute required for removing the clay-like composition from the enclosing packaging material and then performing the measurement using a durometer. Further, the hardness after standing refers to the hardness measured after leaving the clay-like composition to stand for one hour at room temperature after removal from the enclosing packaging material.

When the type E hardness value satisfies the above range, shaping of the composition is simple, and even if the hardness increases somewhat during the shaping process, it does not impede the shaping. Further, when the hardness after standing satisfies the above range, satisfactory flexibility is maintained even after one hour at room temperature, and shaping is possible even after this one hour has passed.

Consequently, it is possible to shape the composition for about 30 minutes to prepare a partially finished product, subsequently store the partially finished product by sealing inside a packaging material, and then once again remove the partially finished product from the packaging material to complete the shaping process at a later time, meaning the composition can be used in those cases where the shaping operation is temporarily interrupted and then restarted at a later time.

Effects of the Invention

The clay-like composition according to the present invention has an initial hardness measured using a type E durometer of E8 to E20, and has a hardness after standing for one hour at room temperature of E40 or less, and therefore the increase in hardness over time is minimal, the excellent flexibility and bendability of the clay-like composition can be maintained, and the shaping time can be lengthened.

BEST MODE FOR CARRYING OUT THE INVENTION

The clay-like composition for forming a sintered precious metal body according to the present invention contains at least one or more powders selected from the group consisting of precious metal powders such as gold powder and silver powder and precious metal alloy powders, an organic binder, an organic additive and water. Propylene glycol can be used favorably as the organic additive, and glycerol and polyethylene glycol may also be added.

This clay-like composition is stored and sold in a wrapped state with the composition sealed with a packaging material having gas barrier properties, and if the hardness measured using a type E durometer immediately after removal of the composition from the packaging material (including the time of about one minute required for performing the measurement) is deemed the initial hardness, and the hardness after standing for one hour at room temperature after removal from the packaging material is deemed the hardness after standing, then the initial hardness is from E8 to E20, and the hardness after standing is E40 or less.

In this description, a type E durometer refers to a test instrument used for measuring low hardness values prescribed in JIS K 6253-1 (hardness measurement range: <A20) (wherein JIS K 6253-1 conforms to ISO 18517, and in ISO 7619-1, a type E durometer is referred to as a type AO durometer).

A more detailed description of the invention is provided below.

(a) Precious Metal Powder, Precious Metal Alloy Powder

For the precious metal powder and/or precious metal alloy powder used in the present invention, gold powder, silver powder, copper powder, platinum powder, or powders of alloys of these metals can be used. Further, a mixed powder of silver powder and copper powder may also be used. In terms of silver alloy powders, a silver-copper alloy can be used particularly favorably. At least one powder selected from the group consisting of these precious metal powders and precious metal alloy powders functions as the main component that constitutes the clay-like composition for forming a sintered precious metal body. The amount of this powder is not a predominant condition, provided the effects of the present invention are achieved, but in order to obtain a more practical clay-like composition, the amount of the powder is preferably at least 50 mass % but not more than 95 mass %. In other words, if the amount is less than 50 mass %, then the texture and luster of the precious metal may not appear, whereas if the amount exceeds 95 mass %, then the extensibility and strength of the clay-like composition tend to deteriorate undesirably. The amount of the one or more powders selected from the group consisting of precious metal powders and precious metal alloy powders within the clay-like composition for forming a sintered precious metal body is more preferably at least 70 mass % but not more than 95 mass %.

(b) Organic Binder

The organic binder used in the present invention may be formed from one material, or a combination of two or more materials, selected from among cellulose-based binders, polyvinyl-based binders, acrylic-based binders, wax-based binders, resin-based binders, starch, gelatin and flour. Further, among the above, the organic binder is preferably formed from a cellulose-based binder, and is most preferably formed from a water-soluble cellulose such as methyl cellulose.

The amount of this organic binder is not a predominant condition, provided the effects of the present invention are achieved, but in order to obtain a more practical clay-like composition, the amount of the organic binder in the clay-like composition for forming a sintered precious metal body is preferably at least 2 mass % but not more than 12 mass %, and is more preferably at least 2 mass % but not more than 10 mass %.

(c) Organic Additive

Propylene glycol can be used as the organic additive used in the present invention. In this case, if the amount of the organic additive is too small, then the composition tends to dry over time, increasing the likelihood of a reduction in the flexibility, whereas if the amount of the organic additive is too large, then the formability of the clay-like composition tends to deteriorate, and therefore the amount of the organic additive is preferably from 0.1 mass % to 3.0 mass %, and more preferably from 0.5 mass % to 2 mass %.

Moreover, by also adding at least one other organic additive selected from the group consisting of glycerol and polyethylene glycol in addition to the propylene glycol, the flexibility of the clay-like composition after drying can be further improved.

In those cases when glycerol and a polyethylene glycol are added, the combined mass of the propylene glycol, the glycerol and the polyethylene glycol is preferably adjusted so as to satisfy a range from 0.1 mass % to 3.0 mass %, and is more preferably adjusted so as to satisfy a range from 0.5 mass % to 1.8 mass %. Glycerol and polyethylene glycol are liquid substances that have both hydrophilic and lipophilic properties, and it is known that including these substances in a clay-like composition imparts viscosity to the composition, but by adding these substances to the clay-like composition together with propylene glycol, the effect of the invention in preventing drying of the clay-like composition and deterioration in the flexibility of the clay-like composition even when left to stand for a long period of time can be further strengthened compared with the case where the propylene glycol is added alone.

Moreover, if required, at least one additive selected from among fatty substances, olive oil and surface active agents may also be added to the clay-like composition for forming a sintered precious metal body according to the present invention.

The amount of this additive varies depending on its purpose, but the amount within the clay-like composition for forming a sintered precious metal body is preferably at least 0.1 mass % but not more than 1 mass %, and is more preferably at least 0.1 mass % but not more than 0.5 mass %.

Examples of the fatty substance include organic acids (such as oleic acid, stearic acid, phthalic acid, palmitic acid, sebacic acid, acetylcitric acid, hydroxybenzoic acid, lauric acid, myristic acid, caproic acid, enanthic acid, butyric acid and capric acid), organic esters (such as organic acid esters having a methyl group, ethyl group, propyl group, butyl group, octyl group, hexyl group, dimethyl group, diethyl group, isopropyl group or isobutyl group), higher alcohols (such as octanol, nonanol and decanol), polyhydric alcohols (such as glycerol, arabitol and sorbitan), and ethers (such as dioctyl ether and didecyl ether).

By adding and mixing a surface active agent into the clay-like composition, the solid matter generated by the reaction between the binder and the water can be converted to powder form, and the mixability of the precious metal powder and the binder can be improved. There are no particular limitations on the type of surface active agent, and a typical surface active agent may be used. The term "surface active agent" is a generic name for a substance that has a water-compatible portion (hydrophilic group) and an oil-compatible portion (lipophilic group, hydrophobic group) within the same molecule, and if it satisfies this definition, then the aforementioned polyethylene glycol used in the present invention may also be considered a surface active agent. However, when used in this instance, the term "surface active agent" excludes the polyethylene glycol added with the anticipation of achieving the characteristic effects of the present invention, but rather refers to sodium lauryl sulfate or a polyoxyethylene alkyl ether or the like that is added in a prescribed amount in order to achieve a dispersion or aggregation effect, a foaming or defoaming effect, a wettability improvement effect, a softening and smoothing effect, or an antistatic effect or the like.

When producing a clay-like composition for forming a sintered precious metal body with the type of composition described above, first, the organic binder, the organic additive and the water, and if required the fatty substance, olive oil and/or surface active agent, are stirred and mixed inside a container fitted with a stirrer. The resulting mixed solution is then introduced into a kneading device together with the precious metal powder.

There are no particular limitations on the amount of water in the clay-like composition for forming a sintered precious metal body, but the amount is preferably from 3 mass % to 35 mass %, and is more preferably from 3 mass % to 20 mass %.

A stainless steel kneading device may be used as the kneading device, and the internal walls of the kneading device are preferably coated with CrN. This CrN coating has excellent wear resistance as well as excellent lubricity, and can therefore suppress Fe contamination.

By kneading the precious metal powder and the mixed solution in the kneading device, a clay-like composition can be produced.

In the method described above, the fatty substance or the like was added during the stirring and mixing of the mixed solution, but the organic binder, the organic additive and the water may first be stirred and mixed, with the fatty substance or the like then added when the precious metal powder is kneaded with the mixed solution inside the kneading device.

Following removal from the kneading device, the clay-like composition is divided into blocks of appropriate size, and then wrapped in a packaging material for storage and sale.

Examples of materials that can be used as the packaging material include films formed from resins having gas barrier properties such as polyvinylidene chloride (PVDC), metal foils, and laminated films comprising a metal layer and a resin layer. These packaging materials cover the outer surface of the block of the clay-like composition in a tightly sealed state, thereby preventing contact with the outside air. Further, a bag-like packaging material formed from the types of films described above may also be used. Moreover, instead of using a film, a container capable of accommodating the clay-like composition, such as a box or can or the like formed from a material having gas barrier properties, may also be used as the packaging material.

Immediately after removal from this packaging material, the clay-like composition has an initial hardness, measured using a type E durometer in accordance with JIS K 6253, that is from E8 to E20, and from this initial hardness, has a hardness after standing for one hour at room temperature that is E40 or less. The initial hardness of the clay-like composition is more preferably from E8 to E18, and still more preferably from E8 to E15. Further, the hardness of the clay-like composition after standing for one hour at room temperature is more preferably E36 or less, and the lower limit for this value is preferably at least as large as the initial hardness.

Room temperature refers to a temperature of 15 to 30° C., and preferably 23° C.

In order to produce a sintered precious metal body from this clay-like composition, the clay-like composition is first removed from the packaging material and used to form the desired shaped body by shaping the composition via manual operations such as kneading, stretching and rounding, and the resulting shaped body is then dried by exposure to hot air or the like. The shaped body hardens upon drying, and following additional fine shaping using a file, cutter or chisel or the like as required, the shaped body is fired to produce a sintered precious metal body. Following firing, polishing of the surface reveals the luster of the precious metal, enabling completion of the ornament or the like.

In the shaping operations described above, because the initial hardness of the clay-like composition is from E8 to E20, shaping of the clay-like composition by manual operations following removal from the packaging material is very easy. At this time, the composition exhibits excellent flexibility, and exists in a state where only the surface has dried, meaning it is unlikely to stick to the packaging material, and can be removed easily from the packaging material.

Further, because the hardness of the clay-like composition upon standing for one hour at room temperature following removal from the packaging material is E40 or less, the composition does not harden so much that shaping becomes impossible during the shaping process. The shaping of a ring or the like is usually substantially complete within about one hour of removing the clay-like composition from the packaging material, and if the hardness after standing for this period is still E40 or less, then an essentially stable shaping operation can be performed from that start of shaping until the completion, thus enabling a shaped body of the desired shape to be produced with comparative ease. During the shaping process, the clay-like composition may also be stretched thinly to form a sheet-like shaped body, and this sheet-like shaped body may then be stamped out using a mold or the like. Even in these types of cases, the shaped body is unlikely to suffer cracking or the like.

Furthermore, because the hardness after standing is still comparatively low, the clay-like composition still retains satisfactory flexibility even after removal from the packaging material and subsequent processing into a sheet or wire shape over a period of one hour, and can therefore still be shaped into a final ring shape or the like. Accordingly, it is possible to shape the clay-like composition for about 30 minutes to prepare a partially finished product, subsequently store the partially finished product for a period of time by sealing inside a packaging material, and then once again remove the partially finished product from the packaging material to complete the shaping process.

Because the clay-like composition can be used in these types of cases where the shaping operation is temporarily interrupted and then restarted at a later time, it is possible to perform shaping across a plurality of steps, with the shaping operation interrupted between steps and then restarted at a later time, and therefore shaping can be performed using all manner of methods in shaping classrooms and the like.

Examples

First, methyl cellulose as the organic binder, propylene glycol as organic additives, glycerol, polyethylene glycol, a surface active agent and olive oil, and water were stirred and mixed inside a container fitted with a stirrer, and the resulting mixed solution was then introduced, together with a silver powder, into a kneading device.

By kneading the silver powder, the binder mixed solution and the water inside the kneading device, clay-like compositions having the formulations shown in Table 1 were produced, and each composition was wrapped in a film-like packaging material formed from polyvinylidene chloride.

One week after production, each of these clay-like compositions was removed from the packaging material, and the hardness was measured using a type E durometer in accordance with JIS K 6253. Removing the clay-like composition from the packaging material, installing it in the durometer and then starting the measurement required about one minute. The hardness at this point was recorded as the initial hardness. Further, the hardness after the clay-like composition was left to stand for one hour in a constant-temperature constant-humidity chamber at room temperature and a humidity of 40% was also measured in the same manner using the type E durometer.

Furthermore, in order to evaluate the formability, each clay-like composition was processed, during the one-hour period leading up to the measurement of the hardness after standing, to form two different shaped bodies, namely a sheet-like body having a width of 5 mm, a thickness of 2 mm and a length of 70 mm, and a wire-like body having a diameter of 1.5 mm. Following processing (one hour after removal from the packaging material), the processed bodies were wound around the periphery of a stainless steel circular rod having a diameter of 13 mm, and the bodies were checked for cracking. If one or more cracks of 1 mm or more occurred in either the sheet-like body or the wire-like body, a formability evaluation of "B" was recorded, whereas if no cracks of 1 mm or more occurred in either body, a formability evaluation of "A" was recorded.

The evaluation results are shown in Table 1.

TABLE 1

| | Composition formulation (mass %) | | | | | | | Hardness (type E) | | |
|---|---|---|---|---|---|---|---|---|---|---|
| | Silver powder | Methyl cellulose | Surface active agent | Propylene glycol | Glycerol | Polyethylene glycol | Water and others | Initial hardness | Hardness after standing | Formability |
| Example 1 | 90 | 1 | 0.2 | 0.8 | 0.2 | 0.2 | balance | 10 | 30 | A |
| Example 2 | 90 | 1.2 | 0.2 | 0.6 | 0.2 | 0.2 | balance | 15 | 35 | A |
| Example 3 | 90 | 1.7 | 0.2 | 0.3 | 0.1 | 0.1 | balance | 20 | 40 | A |
| Comparative Example 1 | 90 | 1.2 | 0.2 | 0 | 0 | 0.1 | balance | 22 | 60 | B |

From the results in Table 1 it is evident that each of the clay-like compositions of the Examples not only had a low initial hardness, but also exhibited minimal increase in the hardness over time, with the hardness after standing being E40 or less, did not crack when wound around a circular rod, and was still able to be shaped even after about one hour had elapsed from the initial state.

The present invention is not to be considered as being limited by the above examples, and various modifications can be made without departing from the spirit or scope of the present invention.

The invention claimed is:

1. A clay-like composition for forming a sintered precious metal body, the clay-like composition comprising at least one powder selected from the group consisting of precious metal powders and precious metal alloy powders, an organic binder, an organic additive and water, wherein the organic additive includes propylene glycol, glycerol and polyethylene glycol, an amount of the organic additive is from 0.1 mass % to 3.0 mass %, an amount of the propylene glycol is in a range of 0.3 mass % to 0.8 mass %, an amount of the glycerol is in a range of 0.1 mass % to 0.2 mass %, an amount of the polyethylene glycol is in a range of 0.1 mass % to 0.2 mass %, and the clay-like composition has an initial hardness measured using a type E durometer of E8 to E20, and has a hardness after standing for one hour at room temperature of E40 or less.

2. The clay-like composition for forming a sintered precious metal body according to claim 1, wherein a total amount of the propylene glycol, the glycerol and the polyethylene glycol is from 0.5 mass % to 1.8 mass %.

3. The clay-like composition for forming a sintered precious metal body according to claim 1, further comprising wherein 0.1 mass % to 1 mass % of a surface active agent excluding the polyethylene glycol.

4. The clay-like composition for forming a sintered precious metal body according to claim 1, wherein an amount of the water is from 3 mass % to 35 mass %.

5. The clay-like composition for forming a sintered precious metal body according to claim 1, wherein the clay-like composition is wrapped in a packaging material having gas barrier properties, and the packaging material is one or more material selected from a group consisting of polyvinylidene chloride film, metal foil, and laminated film including a metal layer and a resin layer.

* * * * *